US007093417B1

(12) United States Patent
MacZura

(10) Patent No.: US 7,093,417 B1
(45) Date of Patent: Aug. 22, 2006

(54) METHOD FOR MAKING ROPE

(76) Inventor: David S. MacZura, 9704 E. 55 Pl., Tulsa, OK (US) 74146

( * ) Notice: Subject to any disclaimer, the term of this patent is extended or adjusted under 35 U.S.C. 154(b) by 0 days.

(21) Appl. No.: 11/098,212

(22) Filed: Apr. 4, 2005

(51) Int. Cl.
*D02G 3/06* (2006.01)

(52) U.S. Cl. ..... 57/235

(58) Field of Classification Search ..... 57/31, 57/32, 259, 260
See application file for complete search history.

(56) References Cited

U.S. PATENT DOCUMENTS 2,284,321 A * 5/1942 Kimball ..... 57/32
2,403,317 A * 7/1946 Warren, Jr. ..... 57/260
2,883,822 A * 4/1959 Dorschner ..... 57/31
3,126,699 A * 3/1964 Lefevre ..... 57/3
3,193,904 A * 7/1965 Evans et al. ..... 28/220
3,800,812 A 4/1974 Jaffe
4,519,195 A * 5/1985 Belin et al. ..... 242/447.3

* cited by examiner

*Primary Examiner*—Shaun R Hurley
(74) *Attorney, Agent, or Firm*—Frank J. Catalano

(57) ABSTRACT

Rope is made from one or more rolls of film. The rolls of film are loaded onto spindles and tension is applied to the free end of the film of each roll to dispense the films. The dispensing films are each constricted at a common focal point of tension to create substantially triangular portions defined by the line of departure of the film from its roll and the focal point of tension. The triangular portions of each film are continuously simultaneously preconditioned, as by heat or humidity, as the films are dispensed. The rolls are also continuously rotated during dispensation about a common axis which is skewed in relation to the dispensation axes of the rolls, causing the preconditioned films to twist at the focal point of tension into a strand of rope. The strand of rope is then rounded and post-conditioned, perhaps by water or air cooling, and coiled for storage.

22 Claims, 4 Drawing Sheets

*Fig. 5*

| | POLYROPE 210 | | | | | |
|---|---|---|---|---|---|---|
| | 211 | 213 | 214 | 215 | 216 | 217 |
| | DATE | NOTES | DIA. | MATERIAL TYPE | MATERIAL SERIAL NUMBER | MATERIAL THICKNESS (MILS) |
| 1 | 09/14/04 | NEW TEMP, BRAKE, ICE | 0.1550 | T1-2075 | 6724403222 | 0.75 |
| 2 | 09/15/04 | 15.5" ROLL, NO EDGE FOR BRAKE | 0.1100 | T1-2070 | 6734603322 | 0.70 |
| 3 | 09/15/04 | | 0.2000 | T1-2120 | 6732302120 | 1.20 |
| 4 | 09/16/04 | NEW TEMP, SPEED | 0.1800 | MP2-2010 | 2324304108 | 1.00 |
| 5 | 09/16/04 | 10.5" ROLL, KEPT BREAKING AT CUT | 0.1000 | T1-2080 | 6708904332 | 0.80 |
| 6 | 09/16/04 | BLUE SHEETING | 0.1550 | QP3-2080 | NOT LISTED | 0.80 |
| 7 | 09/23/04 | ORANGE SHEETING | 0.1550 | QP7-2080 | NOT LISTED | 0.80 |
| 8 | 09/25/04 | BLUE SHEETING 7.5" ROLL | 0.0850 | QP3-2080 | NOT LISTED | 0.80 |

| | MACHINE CONDITIONS 220 | | | | | |
|---|---|---|---|---|---|---|
| | 221 | 222 | 223 | 224 | 225 | 226 |
| | OVEN TEMP. (ºF) | BRAKE TENSION (MODEREATE OR HEAVY) | CONTROLLER HEAD SETTING | HEAD MOTOR R P M (CALCU-LATED) | HEAD MOTOR REVOLUTIONS FOR 1 FOOT OF ROPE (CALCULATED) | HEAD ROLLER TO WIND POINT DISTANCE (INCHES) |
| 1 | 188 | MODERATE | 0.7 | 175 | 11.8393 | 26.000 |
| 2 | 177 | MODERATE | 0.7 | 175 | 15.2220 | 38.000 |
| 3 | 186 | MODERATE | 0.7 | 175 | 8.8795 | 38.000 |
| 4 | 206 | MODERATE | 0.9 | 225 | 9.7856 | 32.000 |
| 5 | 204 | MODERATE | 0.7 | 175 | 13.3192 | 17.000 |
| 6 | 205 | MODERATE | 1.0 | 250 | 19.0275 | 22.000 |
| 7 | 207 | MODERATE | 1.0 | 250 | 19.0275 | 22.000 |
| 8 | 208 | MODERATE | 1.1 | 275 | 20.9302 | 10.000 |

| | 227 | 228 | 229 | 230 | 231 | 232 |
|---|---|---|---|---|---|---|
| | OVEN FUNNEL TO MAIN FUNNEL DISTANCE | WIND POINT TO PINCH ROLLER DISTANCE (INCHES) | CONTROLLER TAIL SETTING | TAIL MOTOR R P M (CALCU-LATED) | TAIL MOTOR DIAL SETTING | OUTPUT (FEET PER MINUTE) (CALCU-LATED) |
| 1 | 13.000 | 56.000 | 0.9 | 16.5000 | 160 | 14.7812 |
| 2 | 13.500 | 52.000 | 0.7 | 12.8333 | 140 | 11.4965 |
| 3 | 13.500 | 52.000 | 1.2 | 22.0000 | 180 | 19.7083 |
| 4 | 24.000 | 64.000 | 1.4 | 25.6667 | 205 | 22.9931 |
| 5 | 24.000 | 76.000 | 0.8 | 14.6667 | 155 | 13.1389 |
| 6 | 24.000 | 71.000 | 0.8 | 14.6667 | 155 | 13.1389 |
| 7 | 24.000 | 71.000 | 0.8 | 14.6667 | 155 | 13.1389 |
| 8 | 7.000 | 58.000 | 0.8 | 14.6667 | 155 | 13.1389 |

METHOD FOR MAKING ROPE

BACKGROUND OF THE INVENTION

This invention relates generally to methods for making rope and more particularly concerns a method for making rope from sheets of plastic film.

Rope is typically made by twisting or braiding together strands of material including plant fibers, metallic wires or plastic filaments. Its uses as a utility or all-purpose tool or for specific applications are limited only by the imagination. Rope is used to tie-up, tie down, package, pull, connect, separate, climb, hang, guide, decorate, and so on. Depending on its use, it may be more or less desirable that a rope be strong, stretchable, soft, malleable, thin or aesthetic. Does it tend to fray or unravel, untie too easily or not easily enough, chafe the hands or the pocketbook? It would be nice to be able to select a rope which maximizes the desirable and minimizes the undesirable characteristics for a particular application, but presently known methods and materials used in making rope result in undesirable compromises in some characteristics in order to attain acceptable performance in others.

It is, therefore, an object of this invention to provide a method for making rope which affords flexibility in controlling the magnitude of a wide range of characteristics the rope being produced. Another object of this invention is to provide a method for making rope which produces rope that resists fraying. A further object of this invention is to provide a method for making rope which produces rope that resists unraveling. Yet another object of this invention is to provide a method for making rope which affords a wide range of selectivity in the strength of the rope produced. It is also an object of this invention to provide a method for making rope which affords a wide range of selectivity in the stretchability of the rope produced. Still another object of this invention is to provide a method for making rope which affords a wide range of selectivity in the malleability of the rope produced. An additional object of this invention is to provide a method for making rope which affords a wide range of selectivity in the texture of the rope produced. Another object of this invention is to provide a method for making rope which affords a wide range of selectivity in the thickness of the rope produced. A further object of this invention is to provide a method for making rope which affords a wide range of selectivity in the color of the rope produced.

SUMMARY OF THE INVENTION

In accordance with the invention, a method is provided for making rope from one or more rolls of film. The rolls of film are loaded onto spindles, one roll to each spindle, each spindle aligned on the dispensation axis of its roll. Tension is applied to the free end of the film of each roll to continuously rotate the rolls about their spindles to simultaneously dispense the films from their rolls. The dispensing films are constricted at a common focal point of tension to create substantially triangular portions of each film. For example, the films may be pinched between one or more pairs of cooperating rollers. Each triangular portion is defined by the line of departure of its dispensing film from its roll and the focal point of tension. The triangular portions of each film are continuously simultaneously preconditioned as the films are dispensed from their rolls through the focal point of tension. For example, heat or humidity or both may be applied to cause the films to become malleable without melting. The rolls of film are continuously rotated during dispensation about a common axis which is skewed in relation to the dispensation axes of the rolls. This causes the preconditioned films to twist at the focal point of tension into a strand of rope. The strand of rope is then rounded, if necessary, in cross-section, perhaps by pinching the strand of rope between one or more pairs of cooperating rollers. The strand of rope, or rounded strand of rope, may then be post-conditioned, for example by water or air cooling the strand of rope. The rope, having been rounded or post-conditioned as necessary, can be coiled for storage. If more than one roll of film is to be twisted into a rope, the roll dispensation axes may be parallel to each other or be angularly displaced from each other. The method affords control of the types, widths and thicknesses of sheet material used to produce any rope, the temperature of and tension applied to the sheet material at the focal point of the process and the rate of rotation and linear speed at which the material passes through the focal point. For example, blown flat stock is more malleable and stretchable than rolled stock. Higher temperatures typically produce rope which is less likely to unravel and is thinner and less stretchable. Higher wind/length ratios produce thicker, stronger ropes. The ability to relatively independently control a greater number of factors in the manufacturing method enhances the possibility of achieving a combination of characteristics better suited to the particular intended application of a rope.

BRIEF DESCRIPTION OF THE DRAWINGS

Other objects and advantages of the invention will become apparent upon reading the following detailed description and upon reference to the drawings in which:

FIG. 5 is a chart illustrating relevant data for tests of a method and system according to FIGS. 1 and 2.

While the invention will be described in connection with preferred methods and steps thereof, it will be understood that it is not intended to limit the invention to those methods or steps or to the details of the methods, steps or products illustrated in the accompanying drawings.

DETAILED DESCRIPTION

Figure 1:
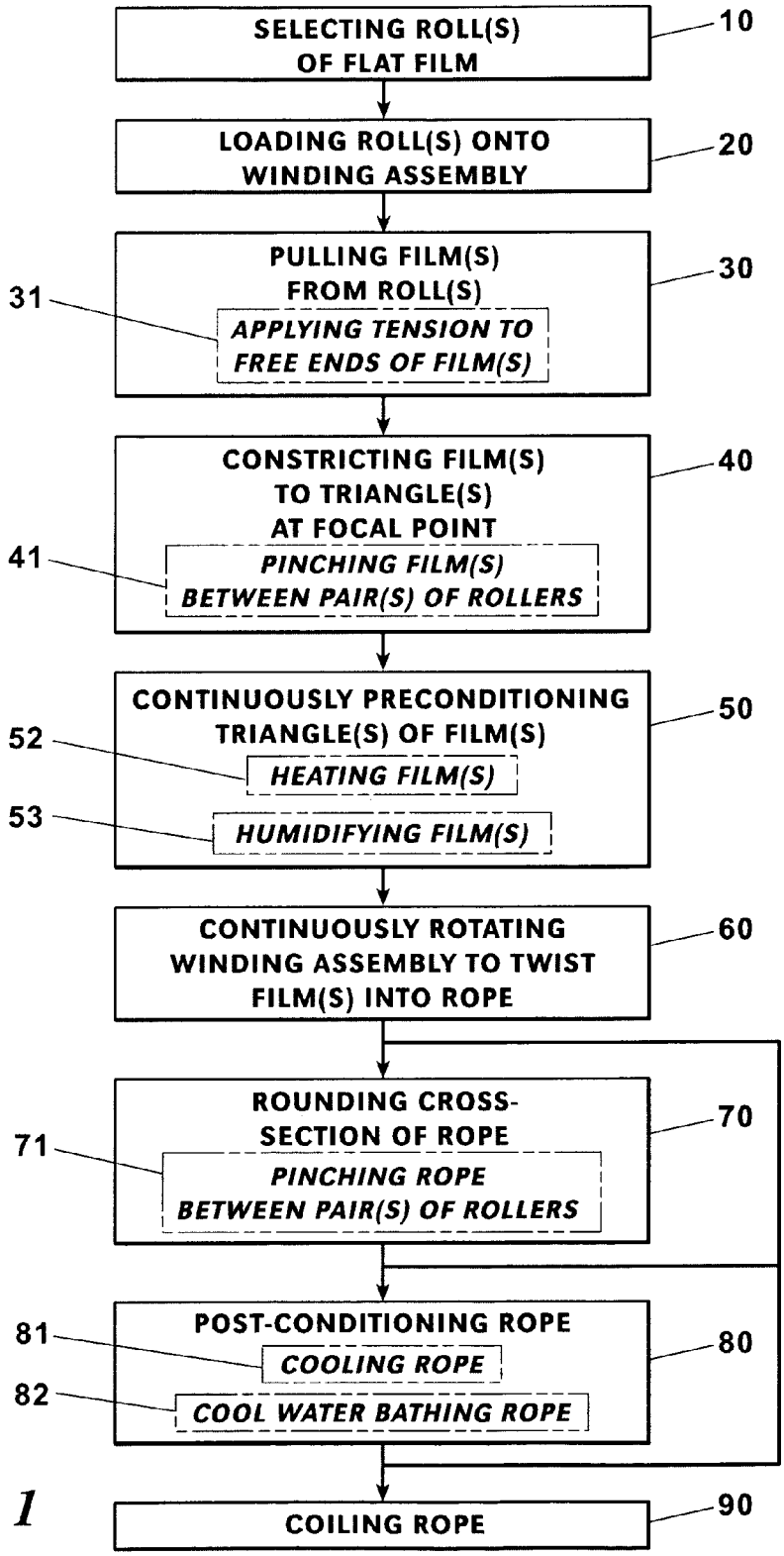
FIG. 1 is a flow diagram of the method for making rope.
Figure 2:
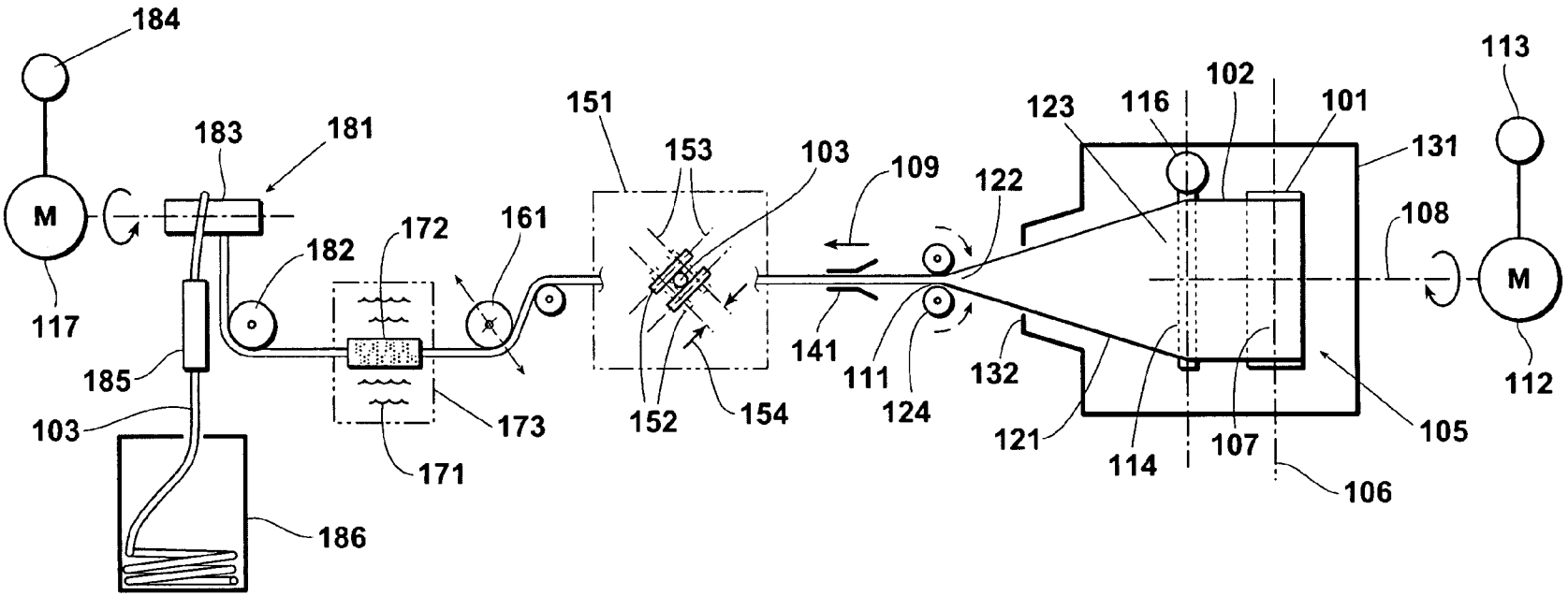
FIG. 2 is a schematic diagram of the components of the rope producing system.

The method is explained in reference to FIGS. 1 and 2. One or more rolls 101 of flat plastic film or sheeting 102 are selected 10 as the feed material for making the rope 103. The rolls 101 may be identical or of differing materials, thicknesses and widths, depending on the desired characteristics of the rope 103 to be made. For example, blown materials afford greater stretchability and malleability than rolled materials and wider and thicker materials produce a thicker, stronger rope. Rolls up to 100" or more in width and in thicknesses ranging from approximately 0.5 to approximately 4 mils may be used.

Figure 3:
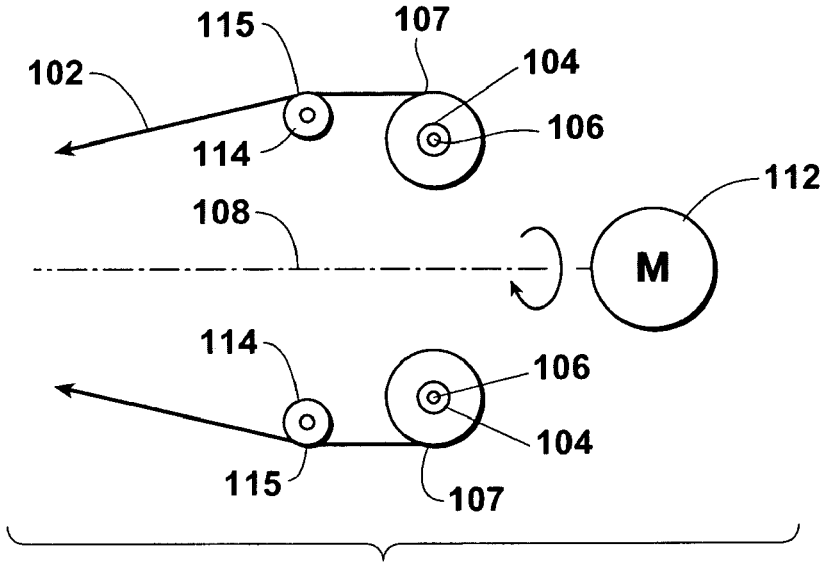
FIG. 3 is a one line diagram illustrating a parallel roll winding assembly of the rope producing system of FIG. 2.
Figure 4:
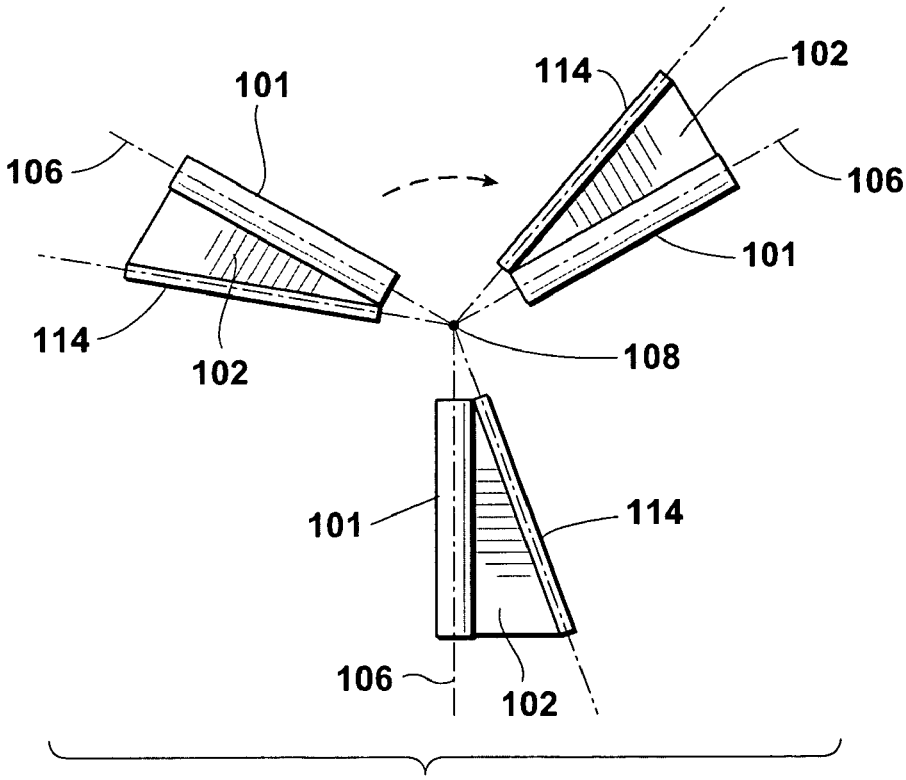
FIG. 4 is a one line diagram illustrating a skewed roll winding assembly of the rope producing system.

Considering FIGS. 1–4, the rolls 101 of film 102 are loaded 20 for rotation on separate spindles 104 on a winding assembly 105, one roll 101 to each spindle 104. Each spindle 104 has its own dispensation axis 106. A primary line of departure 107 at which each film 102 leaves its roll 101 will be parallel to its dispensation axis 106 but will shift as the roll diameter changes. The winding assembly 105 is aligned for rotation about an axis 108 parallel to the direction 109 of the pulling 30 force applied to the film 102 at the focal or wind point 111 of the films 102, as is hereinafter explained. The dispensation axes 106 of the spindles 104 may be parallel to each other and in planes transverse to the winding assembly rotation axis 108, as shown in FIG. 3, or may be angularly displaced from each other about the winding assembly rotation axis 108 and perpendicular to the winding assembly rotation axis 108 as shown in FIG. 4 or skewed from the winding assembly rotation axis 108. The winding assembly 105 is rotated by a drive or head motor 112 at the controller head setting established by a variable speed controller 113. One or more drag tension arm roller guides 114 can be located in the paths of each of the dispensing films 102. The roller guides 114 help to maintain proper tension 31 on the films 102 and also establish secondary lines of departure 115 for the films 102. Thus, as the primary line of departure 107 changes with roll diameter, the secondary line of departure 115 remains constant. If the roller guides 114 are skewed in relation to the dispensation axes 106, their orientation can be set to take up slack in the film 102 between the primary and secondary lines of departure 107 and 115. A brake 116 may also be provided for controlling the tension 31 applied to the supply rolls 101. In a prototype, a torque driven DC motor was used as the winding assembly rotation drive 112. Initial winding assembly motor speeds can be set according to a chart hereinafter explained. Final winding assembly motor speed for a given rope will be determined by trial error and a chart established for each rope producing system. The winding motor speed is ultimately related to both the desired number of rotations of the winding assembly 105 per unit of length of rope 103 produced and to the speed at which rope 103 passes through the focal point of tension 111 which is determined by the tail motor speed. This is further a function of the preconditioning step hereinafter explained. The optimum relationships will be empirically determined.

Looking at FIGS. 1 and 2, once the rolls 101 are loaded and the speed of the winding assembly drive motor 112 is set, tension 31 is applied to the free ends of each of the films 102 to continuously rotate the rolls 101 about their spindles 104 and dispense the films 102 from their rolls 101 simultaneously. Initially, this may be accomplished by hand until sufficient rope 103 has been produced to extend beyond the capstan 183 at the tail motor 117, as is hereafter explained. If the capstan 183 is dispensing completed rope 103 and the rolls 101 of material are to be changed, the free ends of film 102 on the new rolls can be manually tied to the trailing ends of the previous films.

As seen in FIG. 2, the dispensing films 102 are all constricted 40 at a focal point of tension 111. The result is the creation of substantially triangular portions 121 of each film 102 which extend from a base 123 at the primary or secondary, if applicable, line of departure 107 or 115 of the film 102 from its roll 101 to an apex 122 at the wind point or focal point of tension 111. The portion 121 is said to be substantially triangular because the wind or focal point 111 is not truly a point but is the diameter of the rope 109 being produced and because, without treatment of the film 102 as hereinafter explained, the sides of the triangle 121 are longer than the length of material of the triangle 121, which will cause rippling in the material between the head roller at the line of departure 107 or 115 and the wind or focal point 111. Establishing the focal point of tension 111 may be accomplished, for example, by pinching 41 the films 102 between at least one pair of cooperating rollers 124. In operation of a prototype system it has been found that a substantially triangular portion 121 in which the distance from the apex 122 at the focal point of tension 111 to the base 123 at the line of departure 107 or 115 is approximately 1.5 times the width of the widest roll 101 of film 102 being twisted works efficiently.

Looking at FIGS. 1 and 2, the substantially triangular portions 121 of the films 102 are continuously, simultaneously preconditioned 50 as they are dispensed from their rolls 101 through the focal point of tension 121. This can be accomplished, for example, by applying heat 51 or humidity 52 or both to cause the films 102 to become malleable without melting. In a prototype, the spindle portion of the winding assembly 105 rotates inside of a heating chamber 131 which conically narrows at its funnel exit 132 toward the focal point 111. The heating chamber 131 is thermostatically monitored and controlled to maintain the chamber 131 at a temperature coordinated with the tail motor speed to provide a desired temperature of the material at the focal point 111. The heated film 10-2 will stretch to reduce the rippling effect of the triangle 121. In early runs of a rope producing system, temperature, humidity or other environmental condition level settings will be empirically adjusted and determined.

Considering FIGS. 1–4, as the rolls 101 of film 102 are dispensing, they are continuously rotated 60 with the winding assembly 105 about the common winding assembly axis 108. Since the winding assembly axis 108 is skewed in relation to the primary 101 or, if applicable, secondary 115 lines of departure from the rolls 101, the preconditioned films 102 twist or wind together at the predetermined focal point of tension 111. This converts the flat sheet material 102 into a generally rounded strand of rope 103. As the rope 103 exits through the focal point rollers 124, it is directed through a feed guide such as a main funnel 141 toward the upstream components of the rope producing system. The angles of the lines of departure 107 or 115 of the films 102 from their rolls 101 or rollers 114 with respect to each other and with respect to the winding assembly rotational axis 108 are also factors which change the characteristics of the rope 103 produced. These angles will also be subject to empirical determination.

Continuing to look at FIGS. 1 and 2, the cross-section of the strand of rope 103 is then rounded 70, perhaps by pinching 71 the strand of rope 103 between at least one pair of cooperating rollers or in a labyrinth 151 of pairs of rollers 152 and/or pulleys. The axes of rotation of each pair of pinch rollers 152 may be aligned radially differently in relation to the rope 103 and be spring biased 154 toward each other to assure the desired rounding. Rounding stabilizes the rope 103 in its desired cross-section. Once rounded, the rope 103 may pass across a damper 161 to maintain the desired tension in the rope 103. The rounded strand of rope 103 may then be post-conditioned, perhaps by cooling the strand of rope 103 in a liquid bath 81. In a prototype, the rope 103 is cooled 82 by water 171 sprayed into a tube 172 through which the rope 103 passes and recycled from a collecting reservoir 173. The nature of the post-conditioning step 80 will typically, though not necessarily, be determined by the nature of the pre-conditioning step 50. For example, since the prototype pre-conditioning step 50 is heating 51 the flat input material, the-post-conditioning step 80 is cooling 81 the rope.

Looking at FIGS. 1, 2 and 5, whether or not the rope 103 is post-conditioned after rounding, it feeds through the upstream tail motor assembly 181 which pulls 30 it through the rope producing system. In a prototype, the tail motor assembly 181 includes a guide 182 directing the rope 103 over a capstan 183 driven by the tail motor 117 with a variable speed tail motor controller 184. The tail motor assembly 181 discharges the rope 103 through a guide tube 185 into a spooler 186 where the rope is gravity-coiled 90 for storage or transport.

An empirically developed chart 200 used with a prototype rope producing system in accordance with the present method is seen in FIG. 5. The chart 200 is divided into two main sections, POLYROPE 210 containing material data and MACHINE CONDITIONS 220 containing process data. POLYROPE 210 is divided into seven subsections identifying the DATE 211 of the test, special NOTES 213 for the test, the DIAMETER of the rope produced 214, the MATERIAL TYPE 215 for the rolls of flat sheets, the MATERIAL SERIAL NUMBER 216, if known, and the MATERIAL THICKNESS 217 in mils. MACHINE CONDITIONS 220 is divided into twelve subsections including OVEN TEMPERATURE 221 in ° F., the BRAKE TENSION 222 across the winding assembly guide rollers as moderate or heavy, the CONTROLLER HEAD SETTING 223, the calculated HEAD MOTOR RPM 224, the calculated HEAD MOTOR REVS/FT OF ROPE PRODUCED 225, the HEAD ROLLER TO WIND POINT DISTANCE 226 in inches, the OVEN FUNNEL TO MAIN FUNNEL DISTANCE 227 in inches, the WIND POINT TO PINCH ROLLER DISTANCE 228 in inches, the CONTROLLER TAIL SETTING 229, the calculated TAIL MOTOR RPM 230, the TAIL MOTOR DIAL SETTING 231 and the calculated OUTPUT 232 of rope in feet/minute. The chart shows this data for eight tests. The data is meaningful only in the empirical application since the characteristics of the rope produced is the determinative factor as to the success of the test. But, by analyzing this data in making different ropes with the same rope producing system, a chart can be developed for initial settings for ropes of pre-tested characteristics. In the tests, ropes of varying characteristics were produced which did not fray or unravel. The variations in characteristics that can be achieved are limited only by the creativity in combinations of materials and machine conditions.

Thus, it is apparent that there has been provided, in accordance with the invention, a method for making rope that fully satisfies the objects, aims and advantages set forth above. While the invention has been described in conjunction with specific methods and steps thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A method for making rope comprising the steps of:

loading a roll of film onto a spindle having a dispensation axis;

applying tension to the free end of the film to continuously rotate the roll about the spindle to dispense the film from the roll;

constricting the dispensing film at a focal point of tension to create a substantially triangular portion of film defined by a line of departure of the dispensing film from the roll and the focal point of tension;

continuously preconditioning the triangular portion of film as the film is dispensed from the roll through the focal point of tension;

rotating the roll of film continuously during dispensation about an axis skewed in relation to the dispensation axis to cause the preconditioned film to twist at the focal point of tension into a strand of rope.

2. A method according to claim 1, said step of constricting comprising pinching the film between at least one pair of cooperating rollers.

3. A method according to claim 1, said step of preconditioning comprising at least one of applying heat and humidity to cause the film to become malleable without melting.

4. A method according to claim 1 further comprising the step of post-conditioning the strand of rope.

5. A method according to claim 4, said step of post-conditioning comprising cooling the strand of rope.

6. A method according to claim 4 further comprising the step of coiling the post-conditioned strand of rope.

7. A method according to claim 1 further comprising the step of rounding a cross-section of the strand of rope.

8. A method according to claim 7, said step of rounding comprising pinching the strand of rope between at least one pair of cooperating rollers.

9. A method according to claim 7 further comprising the step of post-conditioning the rounded strand of rope.

10. A method according to claim 9 further comprising the step of coiling the post-conditioned rounded strand of rope.

11. A method for making rope comprising the steps of:

loading a plurality of rolls of film onto a plurality of spindles, one roll to each spindle, each spindle having a dispensation axis;

applying tension to the free ends of the films of each roll to continuously rotate the rolls about their respective spindles to simultaneously dispense the films from their respective rolls;

constricting the dispensing films at a common focal point of tension to create substantially triangular portions of each film, each triangular portion being defined by a line of departure of its dispensing film from its roll and the focal point of tension;

continuously simultaneously preconditioning the triangular portions of each film as the films are dispensed from their rolls through the focal point of tension; and rotating the rolls of film continuously during dispensation about a common axis skewed in relation to the dispensation axes of the rolls to cause the preconditioned films to twist at the focal point of tension into a strand of rope.

12. A method according to claim 11, said step of constricting comprising pinching the films between at least one pair of cooperating rollers.

13. A method according to claim 11, said step of preconditioning comprising at least one of applying heat and humidity to cause the films to become malleable without melting.

14. A method according to claim 11 further comprising the step of post-conditioning the strand of rope.

15. A method according to claim 14, said step of post-conditioning comprising cooling the strand of rope.

16. A method according to claim 14 further comprising the step of coiling the post-conditioned strand of rope.

17. A method according to claim 11 further comprising the step of rounding a cross-section of the strand of rope.

18. A method according to claim 17, said step of rounding comprising pinching the strand of rope between at least one pair of cooperating rollers.

19. A method according to claim 17 further comprising the step of post-conditioning the rounded strand of rope.

20. A method according to claim 19 further comprising the step of coiling the post-conditioned rounded strand of rope.

21. A method according to claim 19, the dispensation axes being parallel to each other.

22. A method according to claim 19, the dispensation axes being angularly displaced from each other.

* * * * *